US011548776B1

(12) United States Patent
Loreto

(10) Patent No.: US 11,548,776 B1
(45) Date of Patent: Jan. 10, 2023

(54) DUAL DILUTION RATE CLOSED LOOP INSERT

(71) Applicant: Knight LLC, Irvine, CA (US)

(72) Inventor: Enrique Loreto, Fullerton, CA (US)

(73) Assignee: Knight, LLC, Irvine, CA (US)

( * ) Notice: Subject to any disclaimer, the term of this patent is extended or adjusted under 35 U.S.C. 154(b) by 102 days.

(21) Appl. No.: 17/033,547

(22) Filed: Sep. 25, 2020

Related U.S. Application Data

(62) Division of application No. 16/056,333, filed on Aug. 6, 2018, now Pat. No. 10,815,117.

(60) Provisional application No. 62/546,849, filed on Aug. 17, 2017.

(51) Int. Cl.
*B67D 7/02* (2010.01)

(52) U.S. Cl.
CPC ..... *B67D 7/0277* (2013.01); *B67D 7/0294* (2013.01)

(58) Field of Classification Search
CPC .. B67D 7/0277; B67D 7/0283; B67D 7/0294; F16K 3/32; F16K 3/34; F16K 3/26; F16K 3/262; F16K 3/265; F16K 3/267
See application file for complete search history.

(56) References Cited

U.S. PATENT DOCUMENTS 1,211,636 A 1/1917 Spray
1,379,904 A * 5/1921 Derby ..... F16K 3/34 251/115
2,071,204 A 2/1937 Hunt
2,612,841 A * 10/1952 Lasley ..... F02M 59/462 417/501
2,780,533 A 2/1957 Braunlich
2,788,244 A * 4/1957 Gilmour ..... B05B 7/12 239/510
3,285,282 A 11/1966 Martin
3,425,664 A * 2/1969 Niskin ..... F16K 3/265 251/344
3,642,249 A * 2/1972 Cruse ..... F16K 3/26 251/344
3,752,183 A * 8/1973 Griswold ..... F16K 31/36 137/504
4,546,959 A * 10/1985 Tanno ..... F16F 9/096 188/313
4,579,143 A * 4/1986 Rollins ..... F23K 5/18 137/238
4,809,740 A * 3/1989 Nevlud ..... F16K 17/24 137/460

(Continued)

*Primary Examiner* — Paul R Durand
*Assistant Examiner* — Randall A Gruby
(74) *Attorney, Agent, or Firm* — Stout, Uxa & Buyan, LLP; Donald E. Stout

(57) ABSTRACT

A consistent water to chemical ratio in each of two described operating modes is achieved by implementing a closed loop insert comprising a single straw with a dual dilution rate. The closed loop insert is installed at the packaging level and is recessed into the neck of the container so that it does not interfere with the bottle cap or the dispensing unit to which it might be attached. The closed loop engages with a mating cap adapter or chemical dispenser that keys up to a closed insert to allow the dilution dispenser to draw chemical out of the container through the use of a vacuum pressure. The dual dilution rate closed loop insert of the invention has two different metering tip sizes that fit inside a single straw closed loop insert, selected based upon operating modes.

9 Claims, 6 Drawing Sheets

(56) References Cited

U.S. PATENT DOCUMENTS 4,901,976 A * 2/1990 Smith ..... E03C 1/046 251/364
5,054,516 A * 10/1991 Okerblom ..... G05D 7/0126 137/504
5,988,456 A 11/1999 Laible
6,142,345 A 11/2000 Laible
6,311,718 B1 * 11/2001 Hafner ..... F16K 31/3855 137/907
6,669,062 B1 12/2003 Laible
6,968,983 B2 11/2005 Laible
8,083,107 B2 12/2011 Laible
8,313,085 B2 * 11/2012 Dempsey ..... F16K 3/32 251/207
D682,103 S 5/2013 Jedlicka et al.
8,557,126 B2 * 10/2013 Futch ..... E03D 9/031 210/232
8,820,587 B2 * 9/2014 Imai ..... B67D 1/0829 222/394
8,844,776 B2 * 9/2014 Haas ..... B67D 7/0294 222/481.5
9,126,725 B1 9/2015 Laible
9,192,949 B2 11/2015 Lang et al.
9,242,847 B1 * 1/2016 Laible ..... B67D 7/0294
9,458,003 B1 10/2016 Laible
9,469,452 B2 10/2016 Schultz, Jr. et al.
10,336,517 B1 * 7/2019 Laible ..... B65D 55/02
10,414,644 B1 * 9/2019 Laible ..... B67D 7/0478
10,508,016 B1 * 12/2019 Laible ..... B67D 7/0294
2003/0056841 A1 3/2003 Dalhart et al.
2005/0101939 A1 * 5/2005 Mitchell ..... A61M 39/26 604/533
2005/0247901 A1 * 11/2005 Wang ..... F16K 3/32 251/206
2013/0037575 A1 * 2/2013 van der Molen ... B05B 11/3087 222/207
2013/0263649 A1 * 10/2013 Storch ..... F16K 25/005 251/366
2017/0297788 A1 10/2017 Defert

* cited by examiner

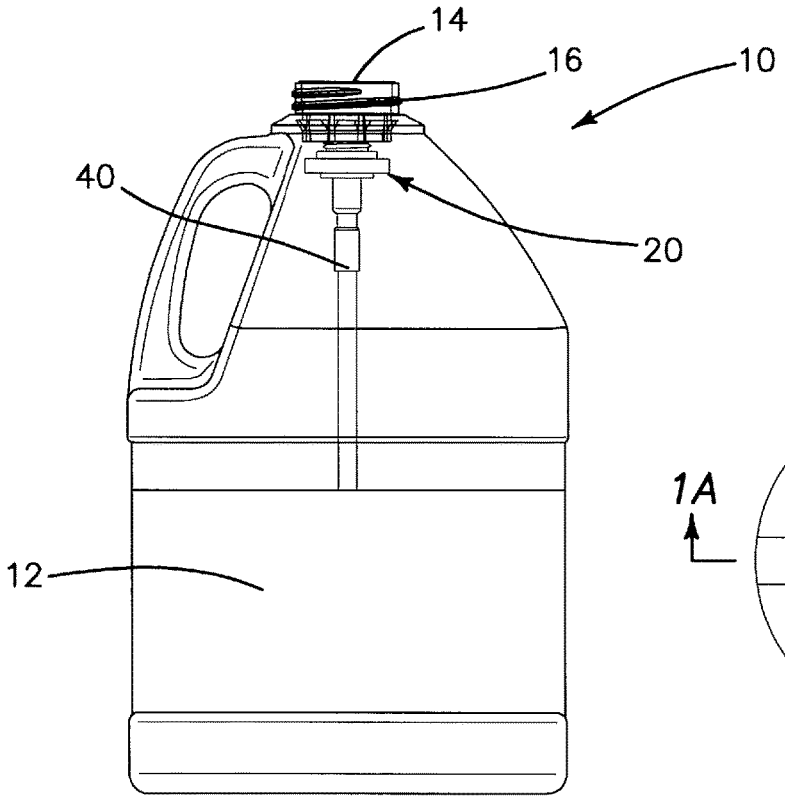
FIG. 1
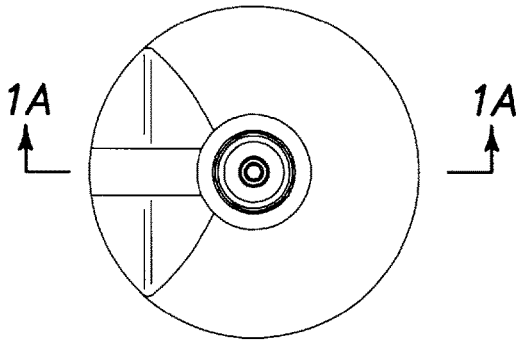
FIG. 1B
FIG. 1A
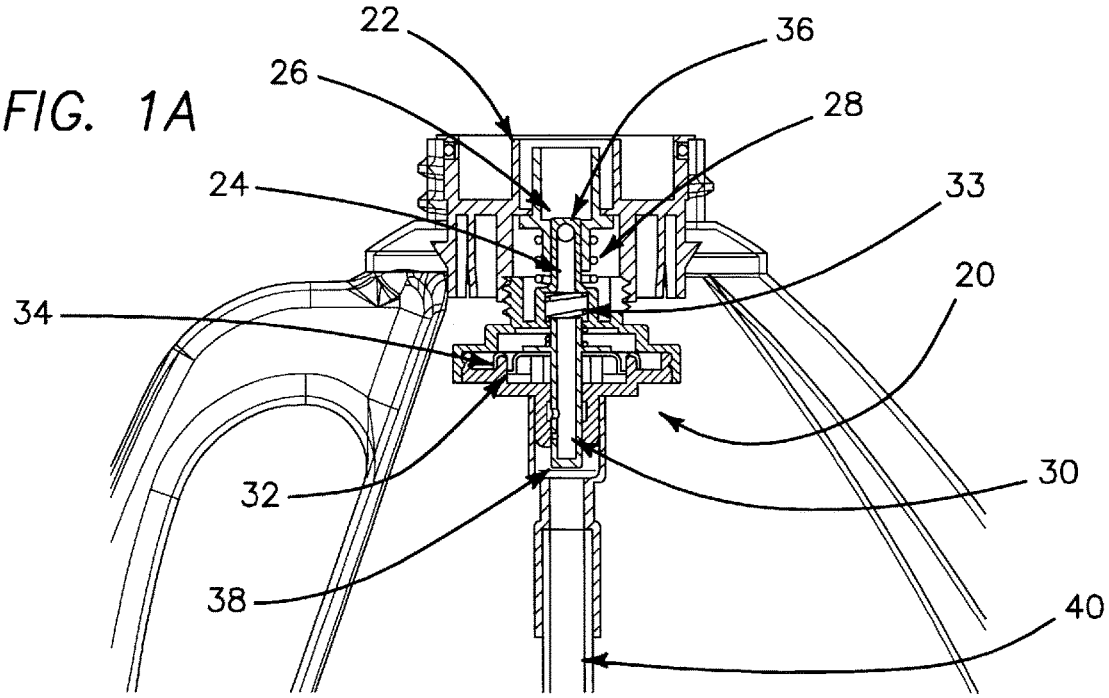

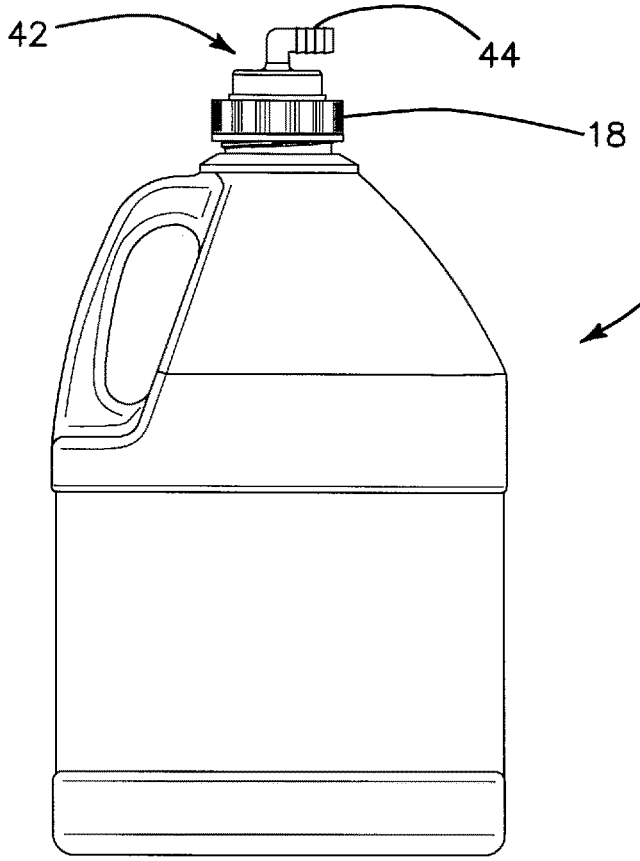
FIG. 2
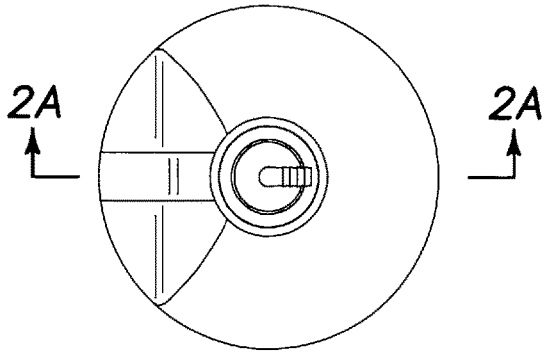
FIG. 2B
FIG. 2A
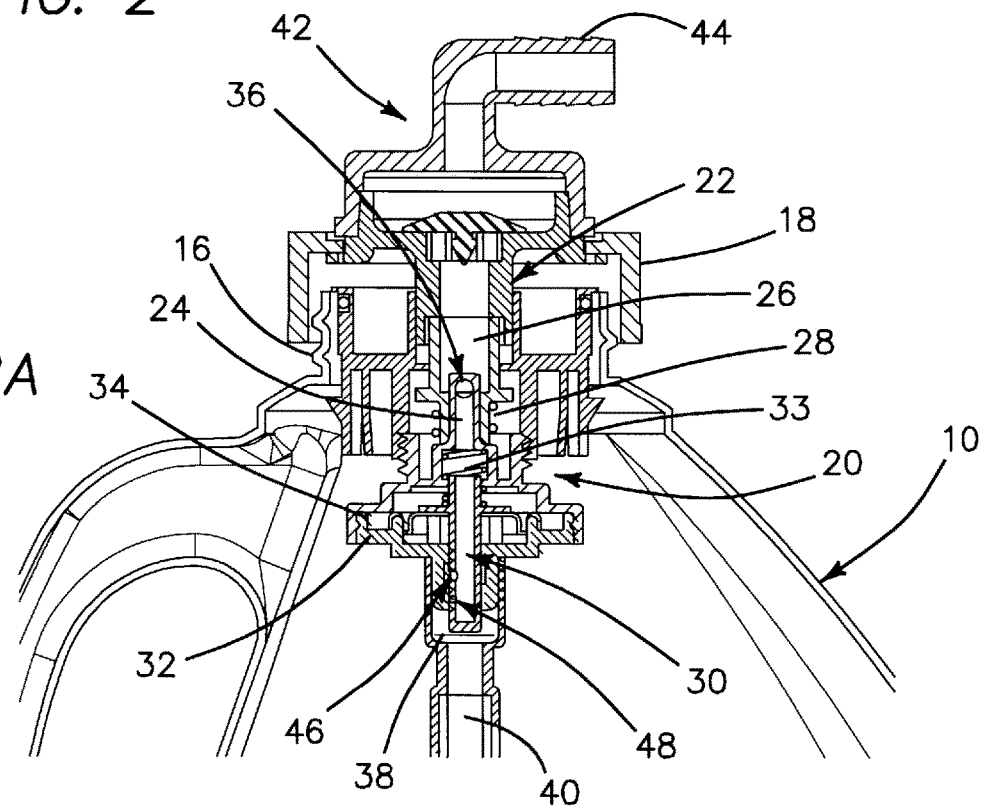

DUAL DILUTION RATE CLOSED LOOP INSERT

This application is a divisional application under 35 U.S.C. 120 of U.S. application Ser. No. 16/056,333, entitled Dual Dilution Rate Closed Loop Insert and filed on Aug. 6, 2018, currently allowed, which in turn claims the benefit under 35 U.S.C. 119(e) of the filing date of Provisional U.S. Application Ser. No. 62/546,849, entitled Dual Dilution Rate Closed Loop Insert, and filed on Aug. 17, 2017. Both of these prior applications are herein expressly incorporated by reference, in their entirety.

BACKGROUND OF THE INVENTION

The chemical dispensing insert business is an approximately $50 million market in North America. Most large janitorial chemical companies use closed loop inserts with their chemical bottles. In North America, inserts fitting into 38 mm bottles are most common in the janitorial cleaning industry. Competitors like RD Industries, Inc., Dema Engineering Company, Hydro Systems, Inc., and Pops all produce their own version of an insert. One such insert is disclosed in U.S. Pat. No. 5,988,456, which is herein expressly incorporated by reference, in its entirety.

Dispensing systems typically have two different operating flow rate modes. One is a bucket fill mode wherein the flow rate is about 3 to 4 gallon per minute (gpm). The other is a bottle fill mode, wherein the flow rate is about 1 gpm. At each of these two different flow rates, the vacuum pull from the tube in the chemical container is different, as should be apparent to those skilled in the art. Also, the chemical to water ratio differs due to the vacuum and water flow differences. The standard closed loop system does not compensate for the two different flow rates and the different dilutions. Currently, chemical companies have to accept that the water dilution ratio for each of the bucket fill and bottle fill dispensing modes necessarily differ. Ideally though, whether in the dispensing bucket fill mode or the bottle fill mode, the water to chemical ratio should be the same. A state of the art way to achieve a more constant water to chemical ratio in each of the above discussed operating modes is by using a dual straw insert.

SUMMARY OF THE INVENTION

The present invention achieves the foregoing objective of a consistent water to chemical ratio in each of the two described operating modes by implementing a closed loop insert comprising a single straw, dual dilution rate closed loop insert.

The closed loop insert of the present invention is installed at the packaging level and is recessed into the neck of the container so that it does not interfere with the bottle cap or the dispensing unit to which it might be attached. The closed loop insert sits inside the chemical bottle and forms a no spill seal on the neck of the bottle to prevent spills or leaks during its transport, storage, and use of the chemical container. The closed loop engages with a mating cap adapter or chemical dispenser that keys up to a closed insert to allow the dilution dispenser to draw chemical out of the container through the use of a vacuum pressure. The dual dilution rate closed loop insert of the invention has two different metering tip sizes that fit inside a single straw closed loop insert. Depending on the vacuum pressure that is created by the respective 1 gpm or 3-4 gpm operating modes, the diaphragm opens and selects one of the two metering tip holes. The closed loop is disposed at the 3-4 gpm metering tip hole in a default position. When dispensing at a 1 gpm flow rate, a higher vacuum suction is achieved, which activates the diaphragm to expose the metering tip hole for the 1 gpm flow rate. The metering tip sizes are calculated depending on the viscosity of the chemical being vacuumed. By doing this, the user is enabled to get the same chemical to water dilution rate whether dispensing for bottle fill (1 gpm) or bucket fill (3 to 4 gpm).

Key components of the inventive system are chemically resistant plastic materials, diaphragms and springs.

More particularly, in one aspect of the invention there is disclosed an exemplary embodiment of a dual dilution rate chemical bottle insert for dispensing chemical fluid stored in a bottle at multiple selected dilution rates, wherein the insert comprises an insert body, a tube extending out of the insert body, a metering poppet disposed in the insert body, a first larger fluid flow hole disposed in the metering poppet for dispensing a first greater volume of fluid through the tube, and a second smaller fluid flow hole disposed in the metering poppet for dispensing a second lesser volume of fluid through the tube. The metering poppet is movable between a first orientation wherein the first larger fluid flow hole is exposed for permitting chemical fluid flow therethrough and a second orientation wherein the second smaller fluid flow hole is exposed for permitting chemical fluid flow therethrough. The second smaller fluid flow hole is covered when the metering poppet is in the first orientation and the first larger fluid flow hole is covered when the metering poppet is in the second orientation. The metering poppet moves between the first and second orientations responsive to applied vacuum pressure levels.

A diaphragm is disposed in the insert body, and is movable with the metering poppet between the first and second orientations. A poppet spring is provided, which is biased to return the metering poppet to a closed orientation when chemical dispensing is not desired. A check valve is disposed in the insert. A cap is engageable with an opening in the bottle, wherein engagement of the cap with the bottle opening moves the check valve to an open orientation to permit flow of chemical from the bottle.

A piston having a piston outlet hole is disposed in the insert, wherein movement of the check valve to the open orientation by the cap opens the piston outlet hole to permit dispensing of the chemical.

In operation, a first applied vacuum pressure moves the diaphragm to thereby move the metering poppet to expose one of the two fluid flow holes and a second applied vacuum pressure moves the diaphragm to thereby move the metering poppet to expose the other of the two fluid flow holes. The lower of the first and second applied vacuum pressures moves the metering poppet to expose the smaller of the two fluid flow holes, and the higher of the first and second applied vacuum pressures moves the metering poppet to expose the larger of the two fluid flow holes.

In one disclosed exemplary embodiment, the check valve comprises an umbrella valve, while in another disclosed exemplary embodiment, the check valve comprises a ball valve. The first larger fluid flow hole permits a diluted fluid flow of about 3-4 gpm and the second smaller fluid flow hole permits a diluted fluid flow of about 1 gpm.

In another aspect of the invention, a method for changing the flow rate of a chemical fluid from a chemical reservoir without changing an insert or dispensing flow tube disposed in the chemical reservoir is disclosed. Method steps include first applying a first vacuum pressure level to a metering device in the insert to expose a first fluid metering hole in the metering device and thereby dispense a first flow rate of the chemical fluid from the chemical reservoir. Then, to change fluid flow without removing or changing the insert, a further step is performed which comprises applying a second different vacuum pressure level to the metering device in the insert, wherein the second different vacuum pressure level exposes a second fluid metering hole in the metering device which is differently sized than the first fluid metering hole to thereby dispense a second flow rate of the chemical fluid from the chemical reservoir, the second flow rate being different than the first flow rate. The step of applying the second different vacuum pressure level comprises moving a diaphragm and an associate metering poppet, the movement of the metering poppet covering the first fluid metering hole and uncovering the second fluid metering hole, responsive to movement of the diaphragm.

The invention, together with additional features and advantages thereof, may be best understood by reference to the following description taken in conjunction with the accompanying illustrative drawings. In these accompanying drawings, like reference numerals designate like parts throughout the figures.

BRIEF DESCRIPTION OF THE DRAWINGS

FIG. 1 is an illustration of a chemical bottle having a dual dilution rate closed loop insert constructed in accordance with the principles of the present invention assembled thereto;

FIG. 1A is a cross-sectional view of the dual dilution rate closed loop insert of FIG. 1, taken along lines 1A-1A of FIG. 1B, illustrated in the closed position;

FIG. 1B is a top view of the chemical bottle shown in FIG. 1;

FIG. 2 illustrates a chemical bottle having a Dual Dilution Rate Closed Loop Insert constructed in accordance with the principles of the present invention and a cap with a barb elbow;

FIG. 2A is a cross-sectional view of the upper portion of the bottle, insert, and cap assembly shown in FIG. 2, taken along lines 2A-2A of FIG. 2B, wherein the assembly is configured for high flow;

FIG. 2B is a top view of the chemical bottle shown in FIG. 2;

DETAILED DESCRIPTION OF THE INVENTION

Figure 3:
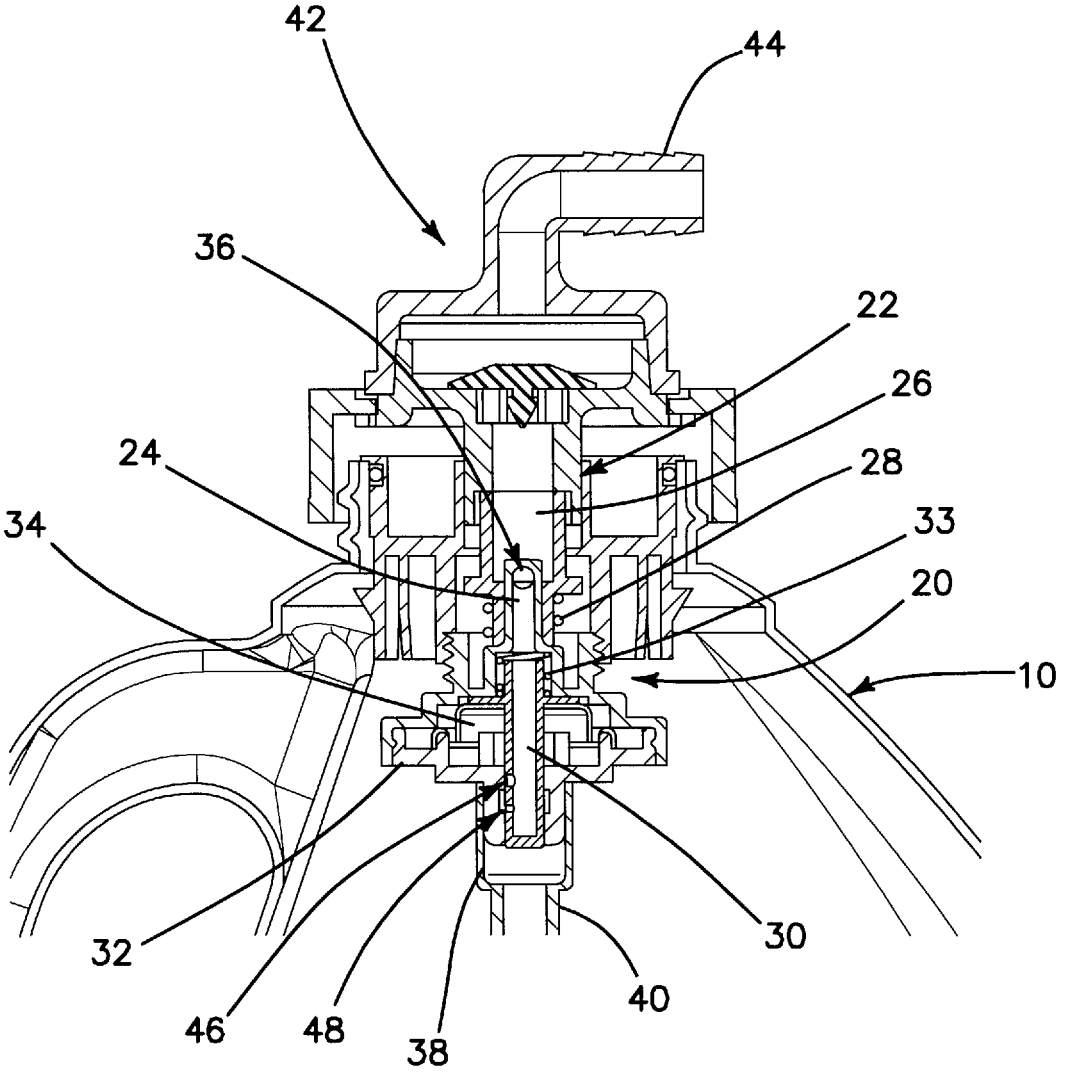
FIG. 3 is a cross-sectional view of the upper portion of the bottle, insert, and cap assembly similar to that of FIG. 2A, wherein the assembly is configured for low flow.

The closed loop insert system has been around for years and been proven to work effectively using vacuum to evacuate liquids from the container to the chemical dispensing equipment. However, the closed loop insert systems available in the market comprise a single straw and a single size metering tip. Most of the time, this single straw is utilized for both the low (bottle) flow fill rate (approximately 1 gpm) and for the high (bucket) flow fill rate (3-4 gpm), which, as discussed above, is a compromise resulting in inaccurate and inconsistent actual flow rates in each flow mode, with too much or too little chemical being used for the two different flow rates. This translates into poor results or a waste of chemical. As also discussed above, sometimes, where accurate flow rates in each flow mode are particularly important or desirable, a two straw system is employed, with a different metering tip in each of the two straws. This dual straw design requires specific chemical dilution dispensers to interface with the dual straw design. This requires the customer/user to change its whole chemical dispensing program, which can be very costly and complex.

The present invention is unique and improved because it employs two differently sized metering tip holes in a single straw, allowing for chemical dilution dispensers to deliver the same chemical-to-water ratio for both identified flow rates. This works based on the application of a pressure differential on a rubber diaphragm, as will be described below. The metering tip holes are chosen based on the vacuum achieved by the selected flow rate, which activates a diaphragm that opens the particular metering tip hole for that selected flow rate. What makes the design unique is that the dual metering tip is designed into a single straw that is able to fit and interface with the majority of chemical dilution dispensers and mating caps used in the industry. This allows users to employ the inventive design without changing up their entire existing dispensing dilution program. The inventive dual dilution rate closed loop in a single straw design enables the user to obtain the correct flow rate of chemical and still be able to use their existing chemical dilution dispensers utilizing a single straw closed loop insert.

The insert locks the chemical into the container to prevent leaks and spills throughout the product life cycle—from shipping to storage to use to disposal. After the chemical is consumed, the bottle with the insert is discarded or recycled. This makes it the "razor blade" of the chemical proportioning market.

Now, with more particular reference to the drawings, an exemplary embodiment of the present invention will be described in greater detail. FIG. 1 illustrates a chemical bottle 10 which is filled with a chemical 12 to be dispensed. An opening 14, having a threaded flange 16 for receiving a cap 18 (FIG. 2) permits dispensing of the chemical 12 from the bottle. A dual dilution rate closed loop insert system 20, constructed in accordance with the invention, is disposed in the bottle 10.

In FIG. 1A, the insert system 20 is illustrated in greater detail. The insert 20 comprises an insert body 22, a stationary piston 24, a sliding valve 26, a sliding valve spring 28, a metering poppet 30, a poppet housing 32, a poppet spring 33, a diaphragm 34, a piston outlet hole 36, a tube adapter 38, and a tube or straw 40.

The FIG. 1A illustration is of the insert 20 in a closed position, meaning that the piston outlet hole 36 is closed (covered) by the sliding valve 26. This is the storage orientation for the bottle 10 with the insert installed therein.

FIGS. 2 and 2A illustrate the bottle 10 with the insert 20, wherein a cap 18 has been threaded onto the flange 16. The cap 18 includes a cap elbow 42 having an outlet passage 44. When the cap is installed, it pushes the sliding valve 26 downwardly, thereby compressing the sliding valve spring 28, consequently exposing the outlet hole 36 of the piston. In this orientation, which is the default position or high flow position, a larger hole 46 on the poppet 30 is exposed for chemical to pass through. In one particular embodiment, this high flow rate is about 3-4 gallons per minute (gpm). A second smaller hole 48 on the poppet 30 is covered in this orientation and not accessible to fluid flow.

FIG. 3 illustrates the insert of FIGS. 2 and 2A, oriented for the lower flow setting (about 1 gpm in one exemplary embodiment). At a higher vacuum (e.g. 23 Hg and above), the diaphragm 34 and metering poppet 30 are pulled upwardly to an "up" position, thereby compressing the poppet spring and thus exposing the smaller poppet hole 48 for chemical to flow through and covering the larger poppet hole 46. Depending upon the applied vacuum pressure, which is dependent on the size of the venture used to draw chemical into the fluid dispensing system (a larger venture, necessary for a higher flow rate, draws a lower pressure, and vice-versa), the diaphragm and metering poppet move upwardly or downwardly to expose the proper metering hole 46, 48 for chemical flow-through. When dispensing of the chemical is completed, the poppet spring 33 is biased to push the diaphragm 34 and metering poppet 30 back to their default position.

Figure 4:
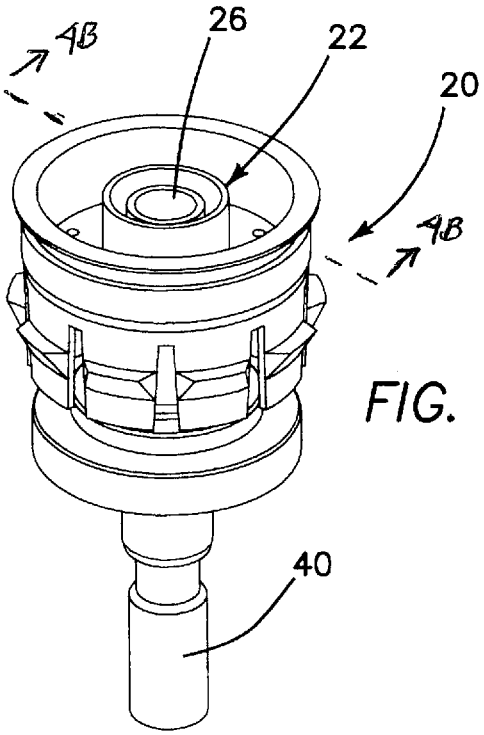
FIG. 4 is an isometric top view of the Dual Dilution Rate Closed Loop Insert of the present invention.
Figure 4A:
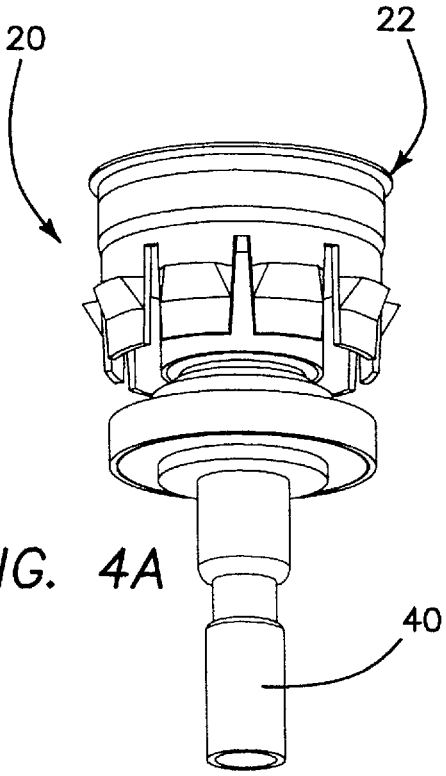
FIG. 4A is an isometric bottom view of the Dual Dilution Rate Closed Loop Insert of the present invention.
Figure 4B:
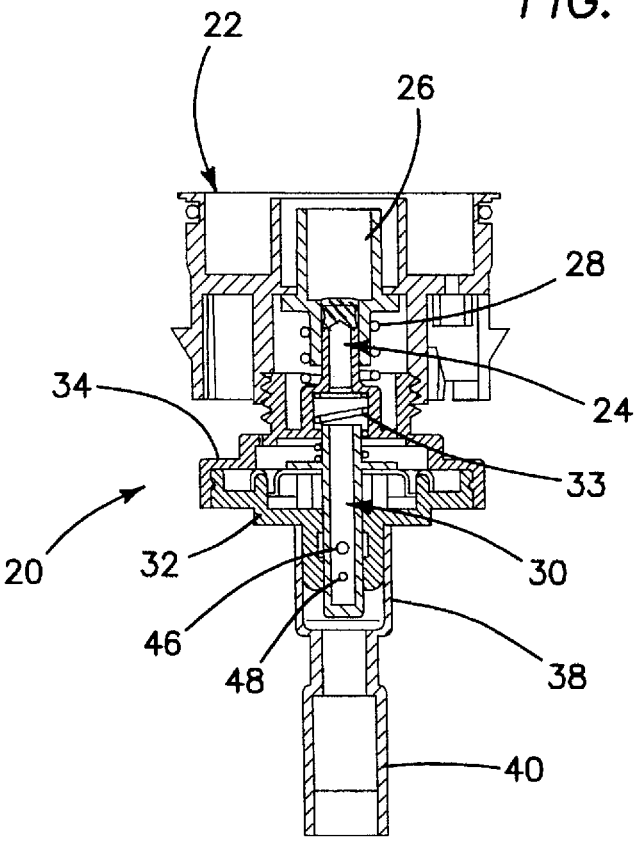
FIG. 4B is a cross-sectional view, taken along lines 4B-4B of FIG. 4, of the Dual Dilution Rate Closed Loop Insert assembly shown in FIGS. 4 and 4A.

FIGS. 4, 4A, and 4B, of course, illustrate the insert system embodiment shown in FIGS. 1-3 and described above in greater detail, for clarity.

A second exemplary embodiment of the insert system 20 of the present invention is shown in FIGS. 5-9B and described below, wherein common elements are identified by like reference numerals.

Figure 5A:
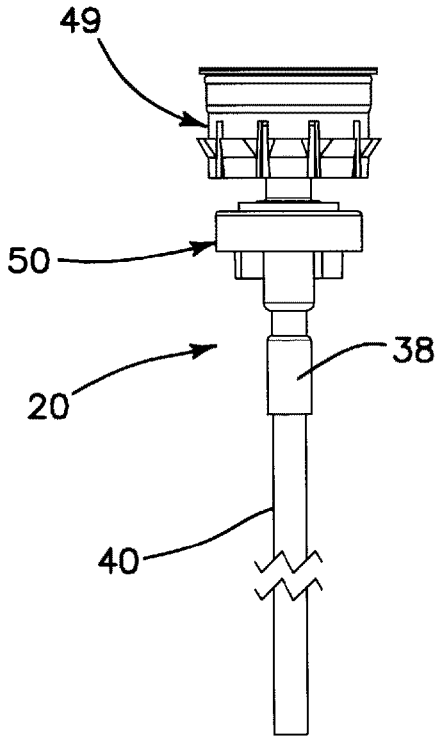
FIG. 5A is an assembled plan view illustrating an exemplary modified embodiment of the Dual Dilution Rate Closed Loop Insert assembly of the invention.
Figure 5B:
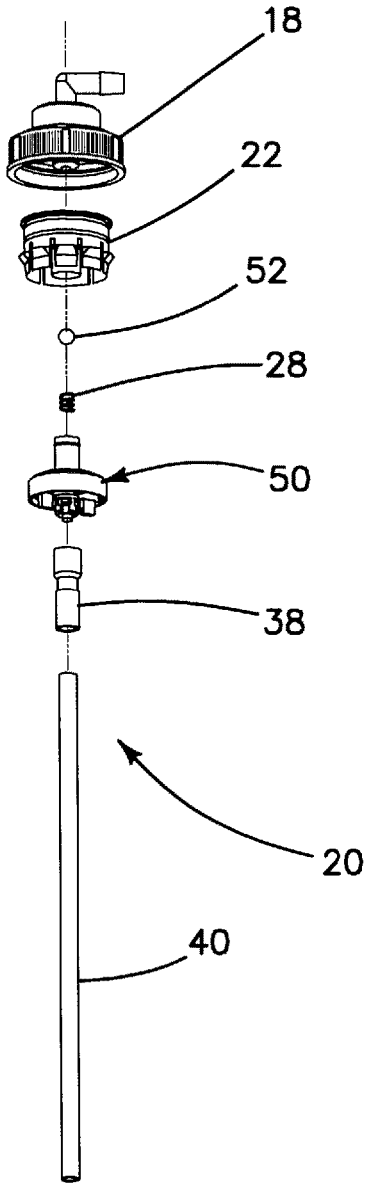
FIG. 5B is an exploded view of the insert shown in FIG. 5A.

In FIG. 5A there is illustrated an assembled version of the insert system 20 of the second exemplary embodiment, and FIG. 5B illustrates an exploded version of that same insert system 20. FIGS. 9A and 9B illustrate the same assembly, absent the pick-up tube 40. The insert system 20 comprises a bottle cap assembly 18, an insert body assembly 49, an adjustable metering assembly 50, a tube adapter 38, and a pick-up tube or straw 40. The insert assembly 20 further includes a plastic ball valve 52 and a sliding valve spring 28. The sliding valve 26 in the embodiment of FIGS. 5A-9B is a ball valve, rather than the umbrella valve disclosed in the embodiment of FIGS. 1-4B. FIG. 9B, in particular, depicts both the smaller metering hole 48 and the larger metering hole 46 on the metering poppet 30.

Figure 6B:
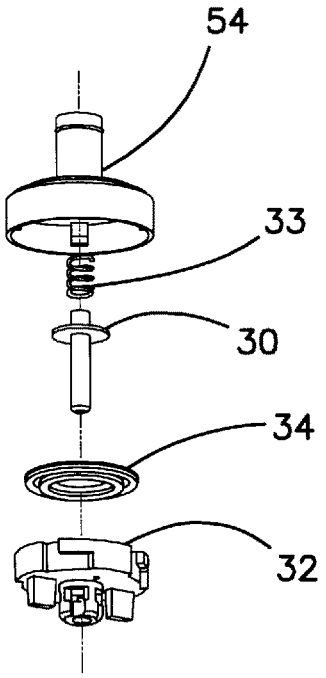
FIG. 6B is an exploded view of the adjustable metering assembly of FIG. 6A.
Figure 6A:
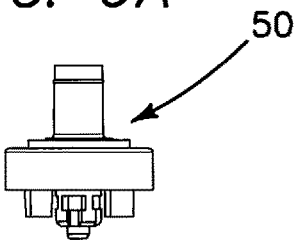
FIG. 6A is an assembled plan view illustrating an exemplary embodiment of the adjustable metering assembly which forms a part of the insert of FIGS. 5A and 5B.

FIGS. 6A and 6B illustrate, in greater detail, the adjustable metering assembly 50. This assembly comprises a top housing 54, a poppet spring 33, a metering poppet 30, a diaphragm 34, made of an elastomeric material such as rubber, and a base or poppet housing 32.

Figure 7A:
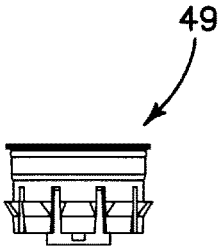
FIG. 7A is an assembled plan view illustrating an exemplary embodiment of the insert body assembly forming a portion of the insert of FIGS. 5A and 5B.
Figure 7B:
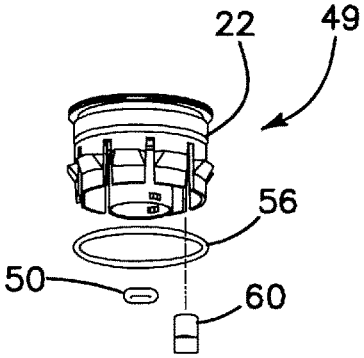
FIG. 7B is an exploded view of the insert body assembly of FIG. 7A.

FIGS. 7A and 7B depict, in greater detail, the insert body assembly 49, which comprises the insert body, an o-ring 56, another o-ring 58, and a duck bill 60.

Figure 8A:
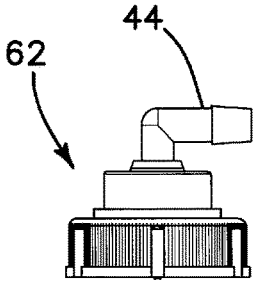
FIG. 8A is an assembled plan view of an exemplary embodiment of the bottle cap assembly forming a portion of the insert of FIGS. 5A and 5B.
Figure 8B:
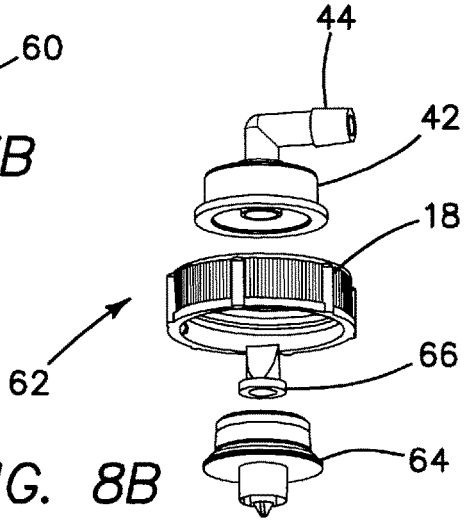
FIG. 8B is an exploded view of the bottle cap assembly of FIG. 8A.
Figure 9A:
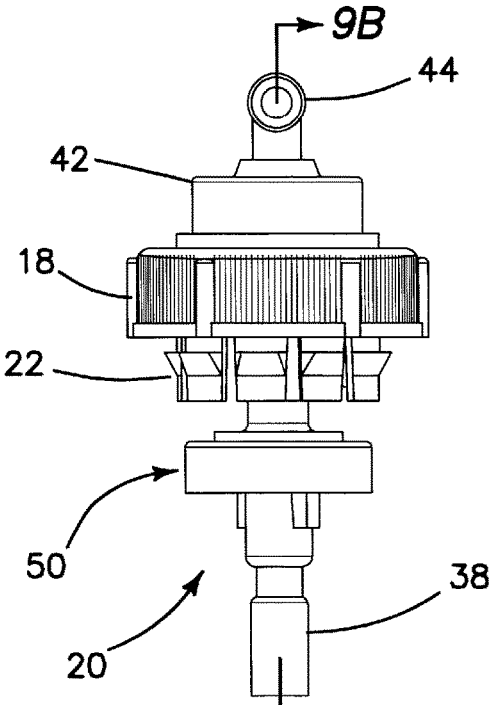
FIG. 9A is an assembled plan view of the insert of FIGS. 5A and 5B, with the pick-up tube removed.
Figure 9B:
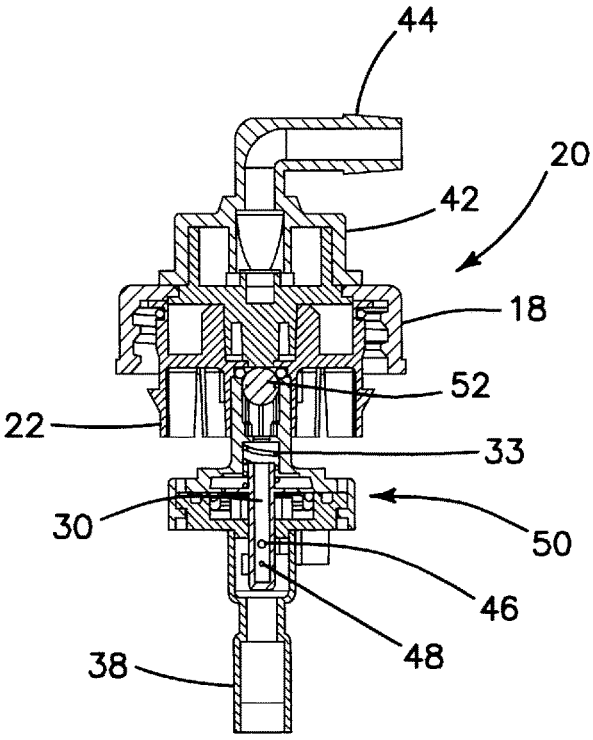
FIG. 9B is a cross-sectional view taken along lines B-B of FIG. 9A.

FIGS. 8A and 8B illustrate the bottle cap assembly 62, which comprises a bottle nut adapter or cap 18, an insert coupler 64, a duck bill 66, and a cap elbow 42. An outlet passage 44 extends from the cap elbow 42.

Although, as noted above, there are some relatively minor structural differences between the embodiments of FIGS. 1-4B and FIGS. 5A-9B, the principle of operation of the embodiment of FIGS. 5A-9B is similar to that described above, with respect to FIGS. 1-4B.

Operationally, as in the first embodiment, the piston outlet hole 36 is closed (covered) by the ball-type check valve 26 when the insert is 20 in a closed position. This is the storage orientation for the bottle 10 with the insert installed therein.

When the cap 18 is installed, it pushes the ball-type check valve 26 downwardly, thereby compressing the sliding valve spring 28, consequently exposing the outlet hole 36 of the piston. In this orientation, which is the default position or high flow position, a larger hole 46 on the poppet 30 is exposed for chemical to pass through. A second smaller hole 48 on the poppet 30 is covered in this orientation and not accessible to fluid flow.

At a higher vacuum (e.g. 23 Hg and above), the diaphragm 34 and metering poppet 30 are pulled upwardly to an "up" position, thereby compressing the poppet spring and thus exposing the smaller poppet hole 48 for chemical to flow through and covering the larger poppet hole 46. Depending upon the applied vacuum pressure, the diaphragm and metering poppet move upwardly or downwardly to expose the proper metering hole 46, 48 for chemical flow-through. When dispensing of the chemical is completed, the poppet spring 33 is biased to push the diaphragm 34 and metering poppet 30 back to their default position.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A method for changing a flow rate of a chemical fluid from a chemical reservoir, the method comprising:

applying a first vacuum pressure level to a metering device in an insert disposed in the chemical reservoir to expose a first fluid metering hole in the metering device and thereby dispense a first flow rate of the chemical fluid from the chemical reservoir; and applying a second different vacuum pressure level to the metering device in the insert, wherein the second different vacuum pressure level exposes a second fluid metering hole in the metering device which is differently sized than the first fluid metering hole to thereby dispense a second flow rate of the chemical fluid from the chemical reservoir, the second flow rate being different than the first flow rate.

2. The method as recited in claim 1, wherein the step of applying the second different vacuum pressure level comprises moving a diaphragm and an associated metering poppet, the movement of the metering poppet covering the first fluid metering hole and uncovering the second fluid metering hole.

3. The method as recited in claim 2, the method further comprising a step of disposing the insert in the chemical reservoir in a storage position, wherein both the first fluid metering hole and the second fluid metering hole are closed, so that no chemical fluid can be discharged from the chemical reservoir.

4. The method as recited in claim 3, and further comprising a step of threading a cap onto a threaded flange surrounding an opening in the chemical reservoir, the cap comprising a cap elbow having an outlet passage therein.

5. The method as recited in claim 4, wherein the step of threading the cap onto the threaded flange exposes an outlet hole in a piston comprising a part of the insert.

6. The method as recited in claim 5, wherein the step of threading the cap onto the threaded flange moves a valve which exposes the outlet hole in the piston.

7. The method as recited in claim 1, wherein the first fluid metering hole is larger than the second fluid metering hole.

8. The method as recited in claim 7, wherein the first flow rate is 3-4 gallons per minute.

9. The method as recited in claim 7, wherein the second flow rate is 1 gallon per minute.

* * * * *